US007478605B2

(12) United States Patent
Modra

(10) Patent No.: US 7,478,605 B2
(45) Date of Patent: Jan. 20, 2009

(54) CARPET MAKING MACHINERY

(75) Inventor: Timothy J Modra, Warragul (AU)

(73) Assignee: Modra Technology Pty Ltd, Warragul, Victoria (AU)

( * ) Notice: Subject to any disclaimer, the term of this patent is extended or adjusted under 35 U.S.C. 154(b) by 289 days.

(21) Appl. No.: 11/241,151

(22) Filed: Sep. 30, 2005

(65) Prior Publication Data

US 2007/0074646 A1 Apr. 5, 2007

(51) Int. Cl.
*D05C 15/30* (2006.01)
*D05C 15/00* (2006.01)

(52) U.S. Cl. ..... 112/80.01

(58) Field of Classification Search ..... 112/163, 112/80.7, 80.73, 80.58, 470.12, 80.43, 80.3, 112/80.6, 80.41, 80.08, 80.01, 80.16
See application file for complete search history.

(56) References Cited

U.S. PATENT DOCUMENTS 1,757,795 A 5/1930 Dahlen
1,883,599 A 10/1932 Dahlen
4,266,491 A * 5/1981 Prichard ..... 112/80.6
4,366,761 A * 1/1983 Card ..... 112/80.41
4,549,496 A * 10/1985 Kile ..... 112/80.08
5,193,472 A * 3/1993 Crossley ..... 112/80.41
5,390,613 A * 2/1995 Shibata ..... 112/80.43
5,653,184 A * 8/1997 Bardsley ..... 112/80.01
5,743,200 A * 4/1998 Miller et al. ..... 112/80.01
6,293,211 B1 * 9/2001 Samilo ..... 112/80.16
6,651,571 B2 * 11/2003 Bennett et al. ..... 112/80.43

* cited by examiner

*Primary Examiner*—Ismael Izaguirre
(74) *Attorney, Agent, or Firm*—Baker & Daniels LLP

(57) ABSTRACT

The specification discloses carpet making machinery (10) with at least one needle head (26) and an associated loop forming head (27) disposed on either side of a pile forming station (28) through which a backing material web (29) is adapted to move in incremental steps, the needle head (26) and the loop forming head (27) being arranged to move relative to the backing material web (29) at the pile forming station (28) selectably either in a transverse direction, a longitudinal direction, or both a transverse and a longitudinal direction of the backing material web (29) with the stitching of pile forming loops (96) occurring in one direction across the backing material web (29), the needle head (26) further including a plurality of needle units (47) carried by a rotatable carriage (66) rotatable about an axis (45), said carriage (66) being arranged upon rotation to move each said needle unit (47) selectably to an operative position.

37 Claims, 9 Drawing Sheets fig 12
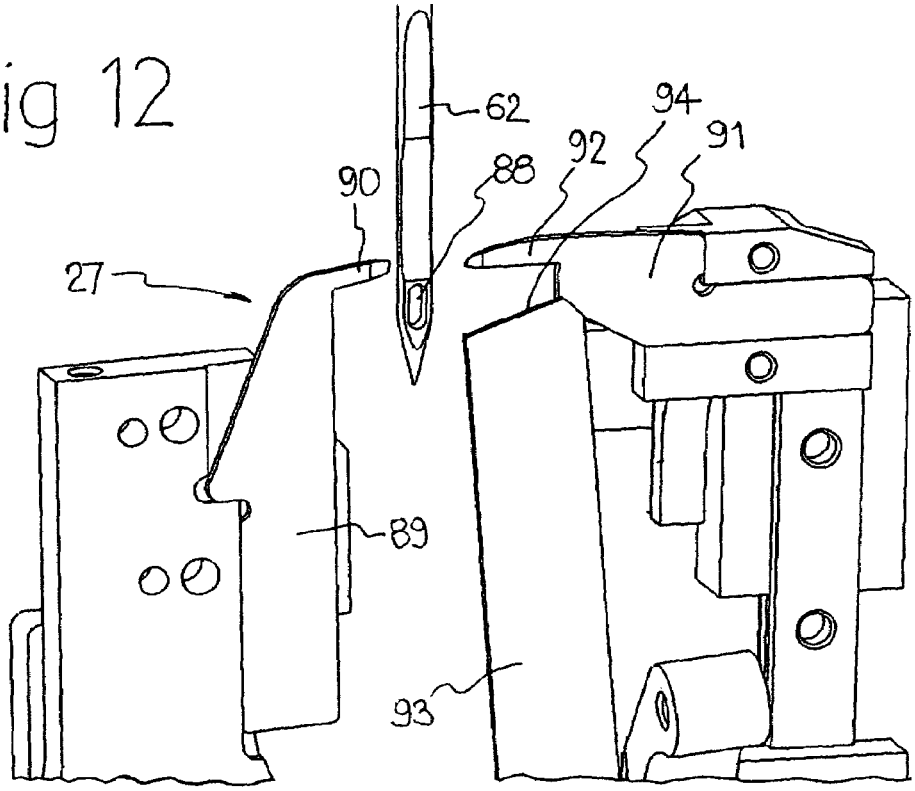
fig 13a
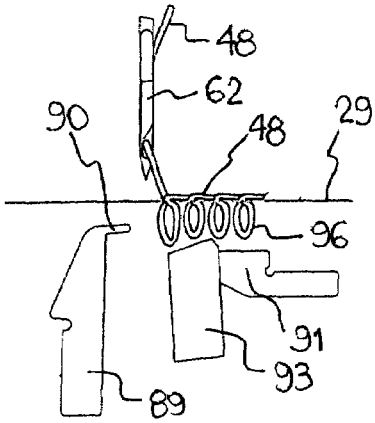
fig 13c
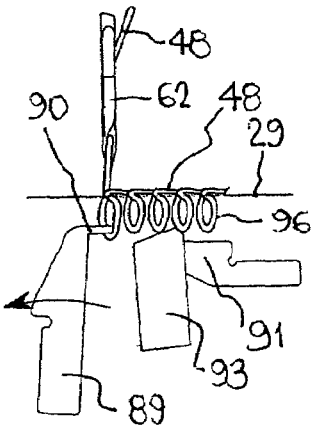
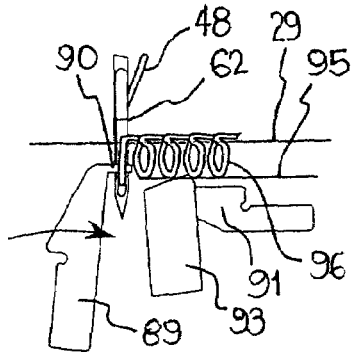
fig 13b

CARPET MAKING MACHINERY

BACKGROUND OF THE INVENTION

The present invention relates to improvements in carpet or rug making machinery, particularly but not necessarily exclusively, of the type adapted to make samples, smaller rugs or carpets of a specialist nature often in limited numbers.

Currently available carpet rug making machinery of the aforementioned type are typically constructed in a manner similar to commercial carpet or rug making machines, that is, with an in line array of needles disposed transversely across a backing sheet or web adapted to form a line of yarn loops in the longitudinal or feed direction of the backing sheet with the backing sheet being incrementally moved in said feed direction each time a yarn loop is formed. A loop forming hook and/or cutting means for each needle is provided on the opposite side of the backing sheet or web and individual or collective yarn feed systems are also provided for each needle in the array. While these systems generally work well and reasonably quickly when commercially making carpet or rugs, the machines are particularly costly, even when built on a smaller scale for making samples. These types of machines also suffer some disadvantages in their levels or ease of adjustability or flexibility when various designs are desired to be made when samples are to be produced. For example, adjustment of the spacing between the needles in the array of needles to vary the distance between the yarn loops formed thereby is difficult and, if possible to achieve, is certainly a slow process to achieve. Further, the ability to alter the direction of the loops to be inclined to the feed or transverse directions is possible with purpose built conventional machines by bodily moving an array of loop forming needles to the left or the right but the flexibility of curved or individual sections of stitching is difficult or impossible to achieve. Producing sections of stitching pile loops in the feed direction alone is certainly extremely difficult or impossible with conventional machines. It is also to be recognized that speed of carpet or rug production is important when carpet or rugs are being produced commercially but it is not so important when samples or specialist limited run carpets/rugs are being made. With sample or specialist limited run production, ease and speed of being able to vary various parameters is generally a more desirable attribute.

While modern carpet or rug making machinery is generally constructed as described above whether it is intended for making samples or commercially sized rugs or carpets, however, it is also recognized that U.S. Pat. Nos. 1,757,795 and 1,883,599 disclose a different type of machine for making commercial sized rugs or carpets where a single needle head to which one yarn filament is fed, the needle head being moved across the backing sheet or web where yarn loops are formed in a line across the backing sheet or web by movement of the needle head. Once a line is produced, either the needle head is moved relative to the previous line produced, or the backing web is moved relative to the needle head, and the needle head is returned to the other side of the backing web to start a new line. No level of adjustability is described in these prior art specifications.

SUMMARY OF THE INVENTION

The objective of the present invention is to provide a carpet or rug making machine, which preferably may be used to make samples or specialist type rugs or carpets that has an increased level of flexibility and adjustability relative to currently known machines of this type.

In the following description and the accompanying claims, reference is made to carpet and carpet making machinery and by this language it is intended to also refer to rugs, rug making machinery and any similar products and equipment.

Accordingly, the present invention provides carpet making machinery including a support and movement means to support and move a backing material web through a pile forming station in first discrete steps in a first direction, at least one needle head supported on one side of said pile forming station for movement in a second direction transverse to said first direction from one lateral region to a second lateral region whereby a needle of the or each said needle head carrying yarn penetrates said backing material web at a plurality of locations and with cooperation of a loop forming head on the other side of said pile forming station forms a plurality of yarn loops on one face of the backing material web, said loop forming head including at least one looper element and a loop cutting mechanism, said loop cutting mechanism being selectably operable independently of operation of said looper element.

Preferred features of this aspect of the invention may be as defined in claims 2 to 22 as annexed hereto, which claims are hereby made part of the disclosure of this specification by this reference thereto.

By the provision of the various adjustments and selections as set out above and hereafter, a very flexible and easily modified carpet making machine is provided particularly suitable for making carpet samples of various test designs as well as specialist rug or carpet designs.

In a further preferred aspect of this invention, there is provided carpet making machinery including a support and movement means to support and move a backing material web through a pile forming station in first discrete steps in a first direction at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forms a plurality of yarn loops on one face of the backing material web, the or each said needle head together with an associated said loop forming head, being mounted to selectably move in at least said second direction while also being selectably movable in said first direction. Preferably, the or each said needle head and its associated said loop forming head are relatively movable in said first direction, conveniently in response to a predetermined positional displacement schedule ensuring correct location of the loop forming head relative to its associated said needle head when a said yarn loop is formed. It is also preferred that the or each said needle head together with an associated said loop forming head be mounted to selectably move in said second direction, said first direction, or both said first and said second directions simultaneously. Further preferred features of this aspect may be as defined in any one of claims 31, 24, 25 or 26, the subject matter of which claims are included in the disclosure of this specification by this reference thereto.

According to a still further preferred aspect, the present invention also provides carpet making machinery including a support and movement means to support and move a backing material web through a pile forming station in first discrete steps in a first direction, at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forms a plurality of yarn loops on one face of the backing material web, the or each said needle head carrying a plurality of said needles whereby each said needle is selectably movable from a non operative position into an operative position, each said needle in use having a separate yarn supplied thereto. Preferred features of this further aspect may be as defined in claims 24, 25 and 26 as annexed hereto, which claims are hereby made part of the disclosure of this specification by this reference thereto.

In yet another preferred aspect, the present invention provides carpet making machinery including a support and movement means to support and move a backing material web through a pile forming station in first discrete steps in a first direction, at least one needle head supported on one side of said pile forming station for movement in a second direction transverse to said first direction from one lateral region to a second lateral region whereby a needle of the or each said needle head carrying yarn penetrates said backing material web at a plurality of locations and with cooperation of a loop forming head on the other side of said pile forming station forms a plurality of yarn loops on one face of the backing material web, the or each said needle head is driven from said second lateral region to said one lateral region without operation of a said needle of the or each said needle head.

Conveniently the or each said needle head may include a plurality of said needles each separately supplied with yarn and each being arranged to form a row of said yarn loops on one face of the backing material substantially simultaneously with other needles of said needle head. The machinery may include two or more such needle heads operating substantially simultaneously to decrease production times. Preferably the or each said needle head together with an associated said loop forming head, are mounted to selectably move in said second direction or said first direction, or both said first and said second directions simultaneously, during components of movement between said lateral regions.

The present invention also anticipates providing a needle head including a plurality of needles supported by a carriage member rotatable about an axis parallel to an operational direction of movement of said needle, said carriage member upon rotation about said axis being arranged to selectively move each said needle from one or more inoperative positions to an operative position.

It will be recognized by those skilled in this art that any of the features disclosed or described in any of the claims annexed hereto or elsewhere in the text of this specification may be used in any of the above discussed aspects.

BRIEF DESCRIPTION OF THE DRAWINGS

One preferred embodiment of the present invention will hereinafter be described with reference to the accompanying representations, in which:

FIG. 12 is a perspective view showing details of the lower loop/cutter assembly shown in previous drawings;

FIGS. 13*a*, 13*b* and 13*c* are schematic stage drawings showing sequential stages in forming loop pile on the backing material web.

DETAILED DESCRIPTION OF THE PREFERRED EMBODIMENTS

Figure 1:
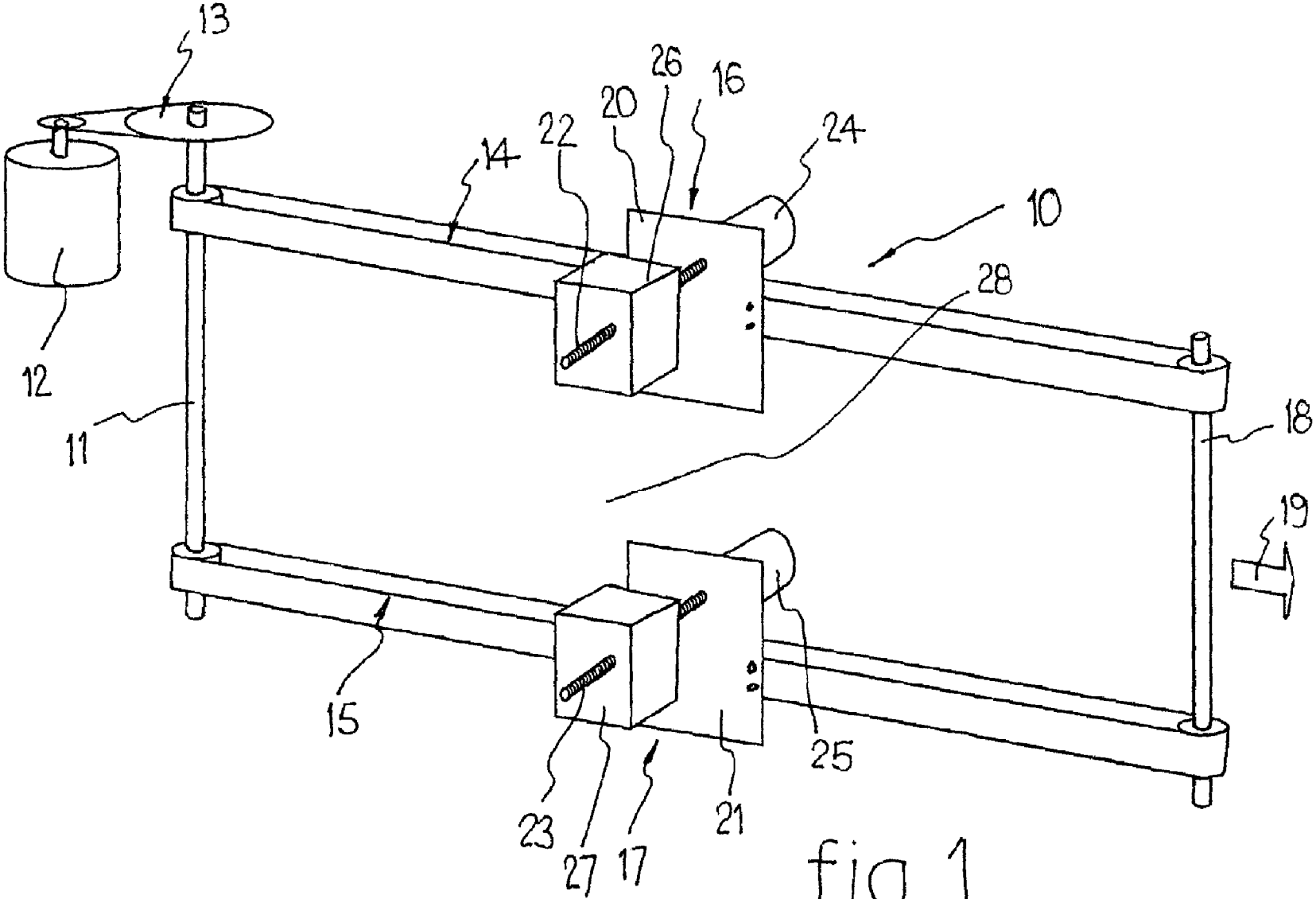
FIG. 1 is a schematic illustrative perspective view of support and movement capabilities of the upper needle head mounting carriage and its associated lower loop forming/cutter assembly.
Figures 2, 2A:
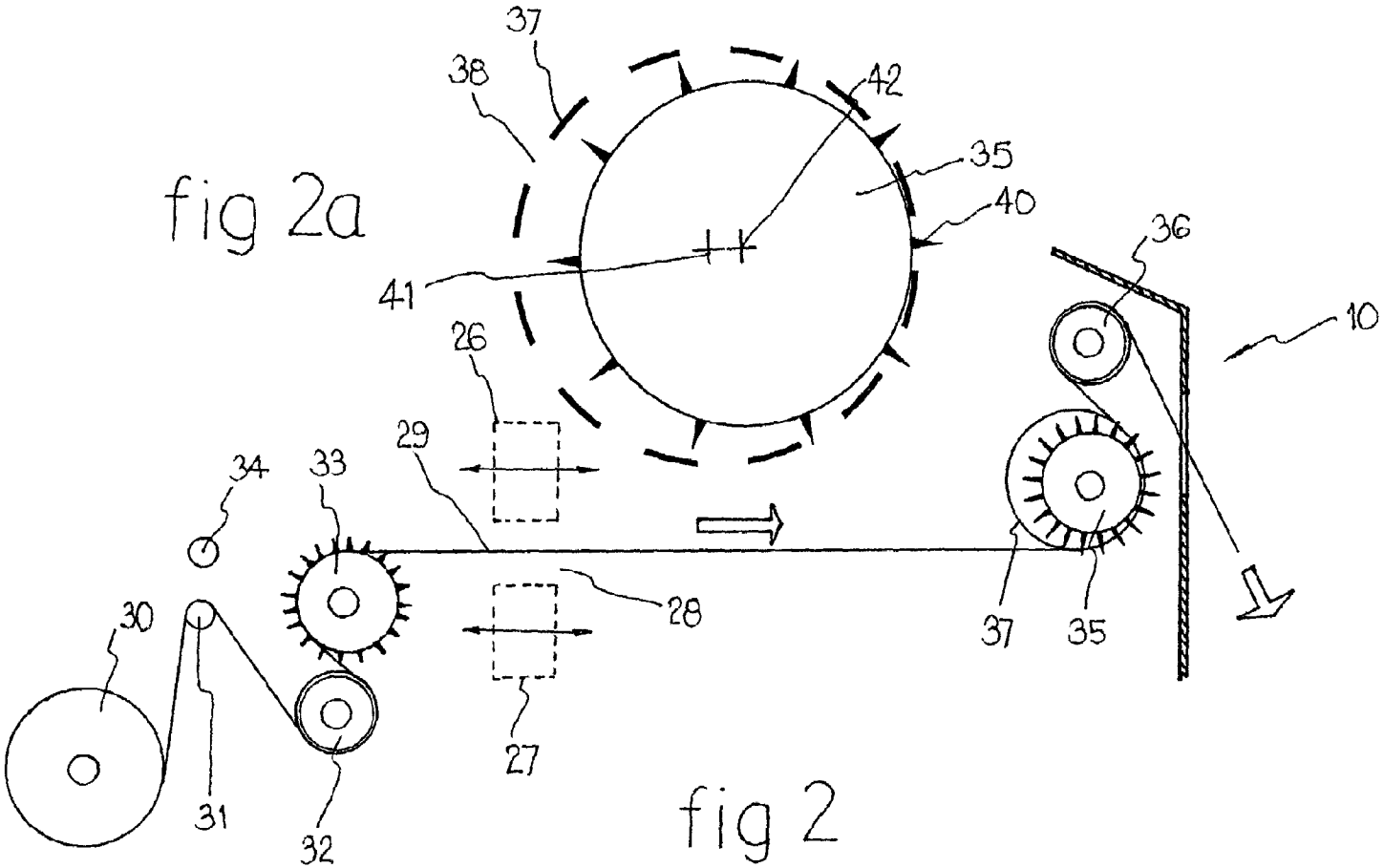
FIG. 2 is a schematic cross-sectional view illustrating the movement of the backing material web generally horizontally through a pile forming station in the space between the upper needle head mounting carriage and the lower loop/cutter assembly shown in FIG. 1.
FIG. 2*a* is a schematic cross-sectional view of the discharge spiked roller and associated tube sheath used in the configuration illustrated in FIG. 2.

Referring initially to the annexed drawings FIGS. 1, 2 and 2*a*, a carpet making machine 10 is schematically illustrated comprising an X-drive shaft 11 driven by a motor 12 and a reduction pulley or gear arrangement 13. The motor 12 may provide rotational movement in either rotational direction such that the shaft 11 might be rotated in selected and adjustable incremental steps or at an adjustable speed whereby pile loops of adjustable length can be selected. It is preferred, however to operate the motor 12 continuously as this provides both a quicker operation and less mechanical and wear difficulties. A pair of drive belts comprising an upper belt 14 and a lower belt 15 is driven by the drive shaft 11 dependent on the rotation of the shaft 11 so as to move upper and lower head assemblies 16, 17 in the X-direction, ie in the direction of the belts 14, 15. Each of the belts 14, 15 are tensioned by a distal rotatable shaft 18 being capable of movement in the direction indicated by arrow 19. The upper head assembly 16 has a mounting plate 20 partly supported by and guided for movement along guide rails (not shown) in the X-direction by means of the mounting plate 20 being secured to the upper belt 14. Similarly, the lower head assembly 17 includes a lower mounting plate 21 secured to the lower belt 15 and for movement therewith but which is also supported and guided on guide rails (not shown). Supported on each of the mounting plates 20, 21 are ball screws (threaded shafts) 22, 23 each being selectably and rotationally driven by motors 24, 25, the ball screws 22, 23 extending in the Y-direction perpendicular to the X-direction, that is transverse to the guide rails and drive belts 14, 15 extending in the X-direction. Ball screw support arrangements (not shown) are provided at the distal ends of the ball screws 22, 23 whereby an upper needle head 26 as described hereafter (see FIGS. 3 to 11) can be selectably moved in the Y-direction by any desired increment in either direction, ie away from or towards the belt 14. Similarly, a lower head 27 comprising a hook, looper and cutter arrangement as described hereafter (see FIG. 12) can be selectably moved in the Y-direction identically to the upper head 26. As also described hereafter, the heads 26, 27 cooperate with one another and it is important that they stay accurately in line with one another. The guide rails (not shown), should therefore be as straight as possible and aligned with each other to try to ensure the operative parts of the heads 26, 27 correctly engage with one another as hereinafter described. While this is desired, it is usually not possible to get these members to the required level of accuracy to ensure proper operation of the heads 26, 27 over the full width of the machine. This width may be of the order of one metre for smaller and sample carpets up to or perhaps even greater than two metres for larger carpet sizes. Thus, to ensure proper operation of the heads 26, 27, they may, in a calibration stage, be moved across the machine in the X-direction while measuring (by any suitable measuring device) any deviations from a mean or correct positional relationship between the operational parts of the heads 26, 27. These deviations may then be input into a controller controlling operation of the motors 24, 25 controlling movement of the heads 26, 27 in the Y-direction to adjust for the aforesaid deviations at any position in the X-direction across the machine.

The positioning of the upper head 26 and the lower head 27 provides a space 28 therebetween through which a backing web 29 passes as shown in FIG. 2. The backing web 29 conveniently is dispensed from a rearwardly located storage roll 30 of such material and passes over a backing wrap bar 31, a rubber coated roller 32 and a conventional rear spiked roller 33. A roll tension bar 34 might also be provided. The spikes of the spiked roller 33 penetrate the backing web 29 and securely hold same while permitting it to be fed horizontally across the space 28 to a front spiked roller 35. The web 29 is tensioned between the two spiked rollers 33, 35. After passing the front spiked roller 35, the backing web 29, now carrying a pile formed thereon, passes around a front rubber coated roller 36 and is discharged forwardly from the machine 10. The front spiked roller has an eccentrically positioned tubular sheath member 37 having a plurality of discrete openings 38 positioned around its periphery whereby the spikes 40 of the spiked roller 35 project through the openings 38 in the tubular sheath member 37 for a short length of its periphery and are located fully within the tubular sheath member 37 for the remainder of its periphery. The position where the spikes 40 might start to extend from the sheath member 37 is not particularly important but it is important that the spikes be withdrawn within the sheath member 37 by the time the backing member leaves the spiked roller 35 to ensure that the spikes 40 do not pull the pile from the backing web 29 (because of the nature of the stitching as described hereafter) as it traverses the front spiked roller 35. The spiked roller 35 does, however, still need to maintain positive engagement of the web 29 within the pile forming station in the space 28 between the spiked rollers 33 and 35. As shown in FIG. 2*a*, the tubular sheath member 37 with peripheral openings 38 is rotated about an eccentrically positioned axis 41 relative to the axis of rotation 42 for the spiked roll 35. Moreover, to ensure the foregoing actioning is achieved, the tubular sheath member 37 is rotated at a speed differential to that of the spiked roll 35. In one possible example, the inner spiked roller 35 might have ten spikes evenly spaced around its periphery with the tubular sheath member having twelve evenly spaced openings 38 of 100 mm diameter. In this possible example the gearing ratio between the tubular sheath member 37 and the inner spiked roller 35 might be 10:12. While the axes 41, 42 are shown horizontally spaced from one another, the axes do not need to be located on the same horizontal plane.

Figure 3:
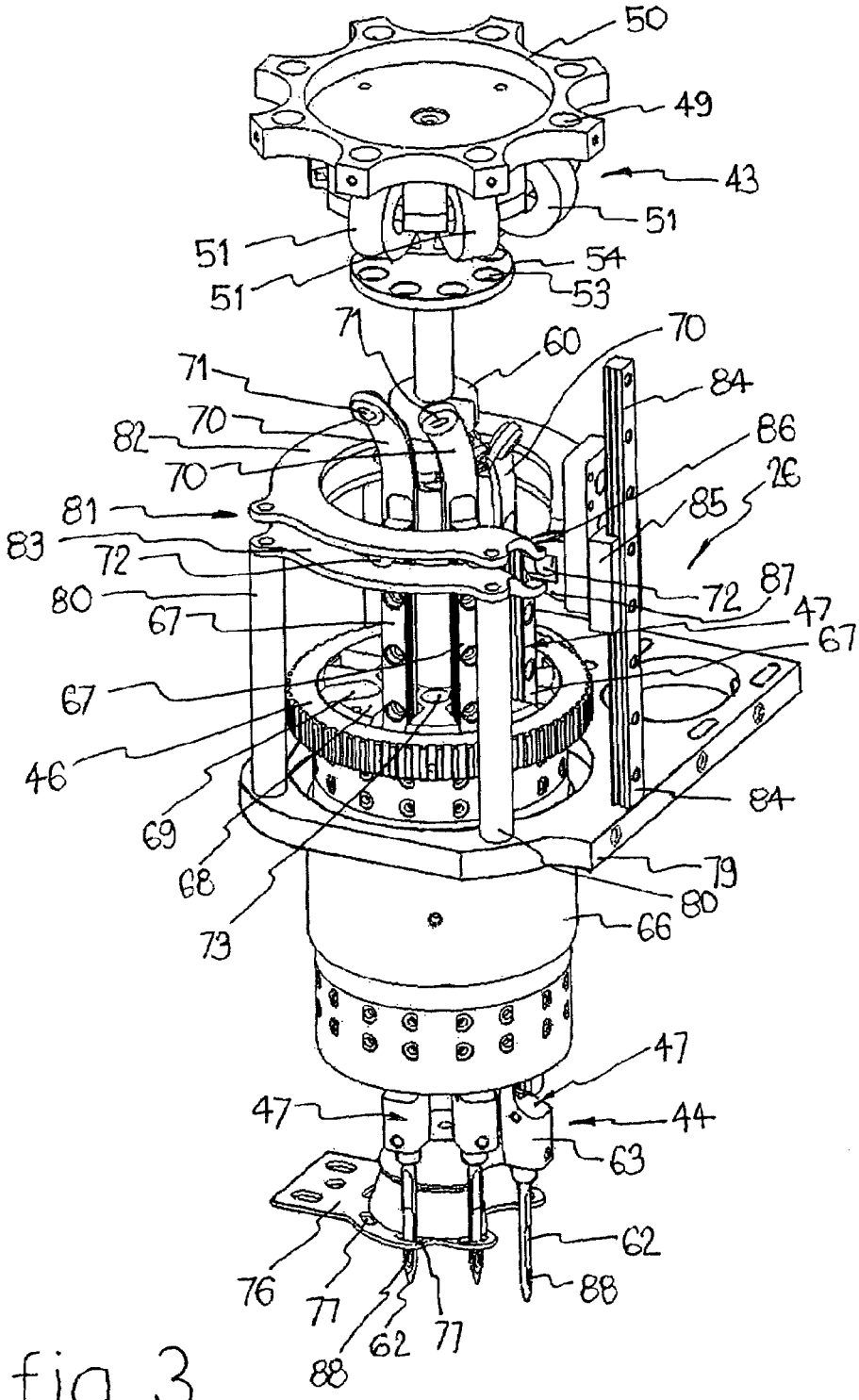
FIG. 3 is a perspective view of one preferred embodiment of an upper needle head mounting carriage with some parts omitted for the sake of clarity.
Figure 4:
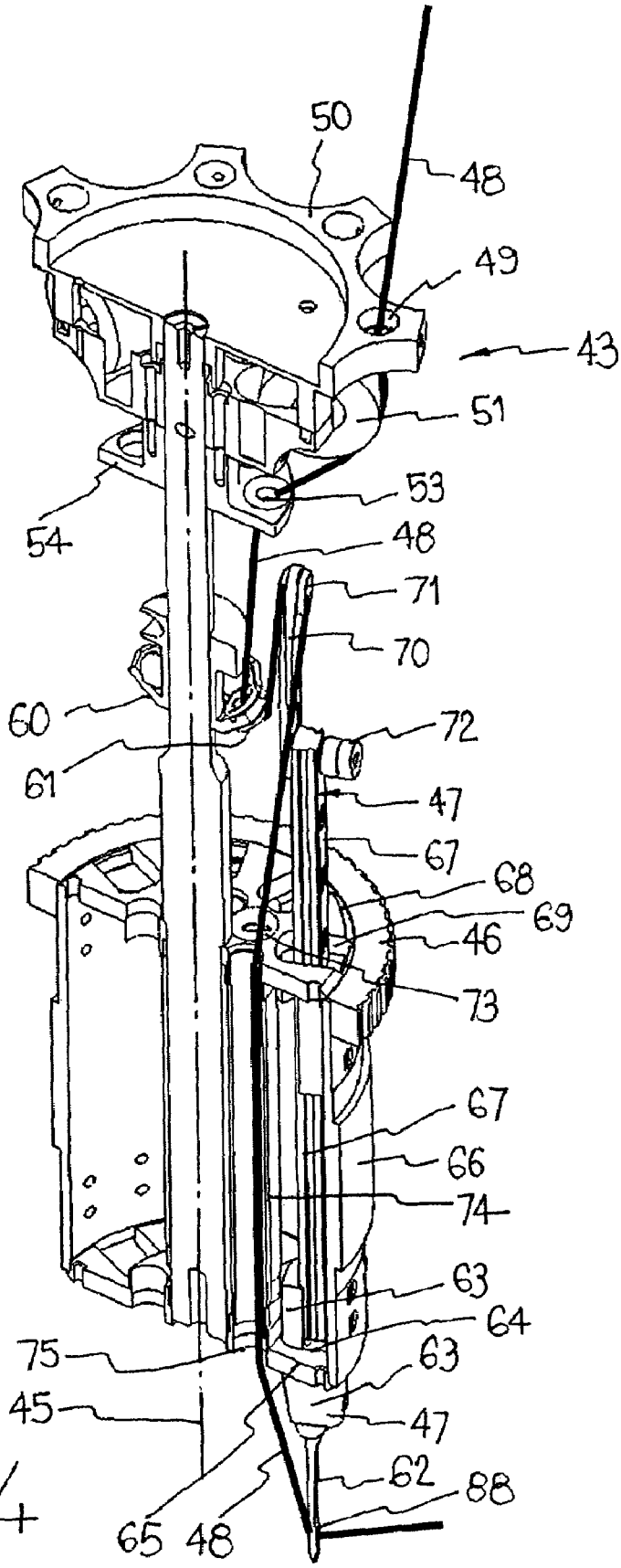
FIG. 4 is a cross-sectional view of the upper needle head mounting carriage shown in FIG. 3 showing the passage of a yarn thread therethrough, it being understood that multiple yarn threads could and normally would be utilized.
Figure 5:
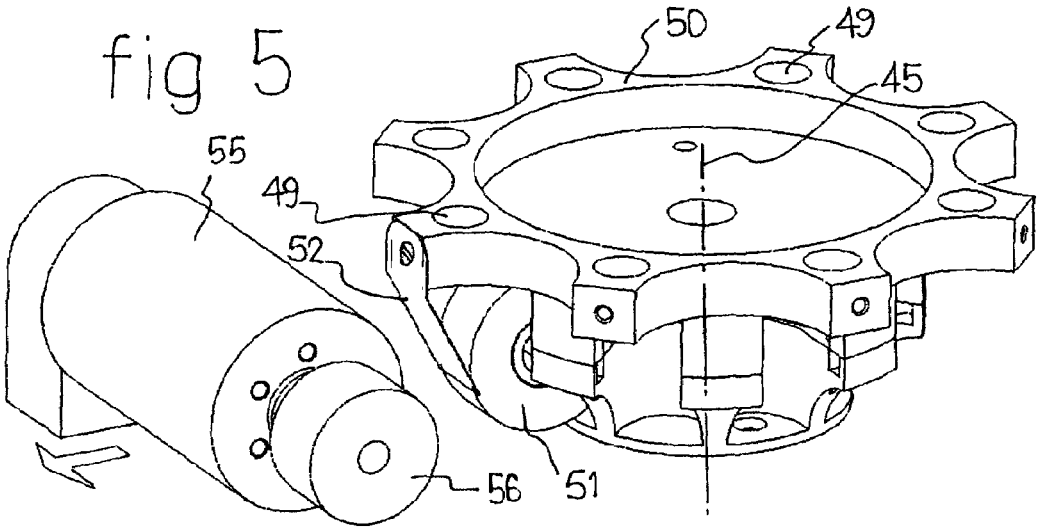
FIG. 5 is a detailed perspective view of the yarn thread feed arrangement utilized in the upper needle head mounting carriage shown in FIGS. 3/4, in a disengaged position, again with some parts omitted for the sake of clarity.
Figure 6:
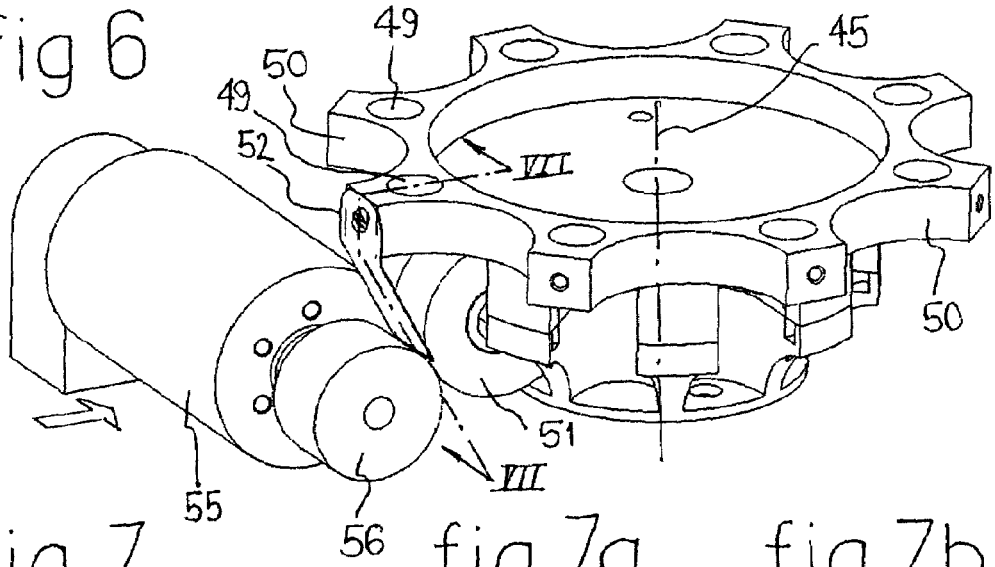
FIG. 6 is a view similar to FIG. 5 but showing the thread feed arrangement engaged.
Figure 7:
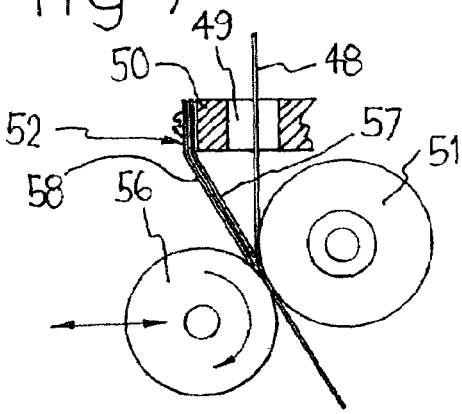
FIG. 7 is a cross-sectional view taken along line VII—VII of FIG. 6.
Figure 7A:
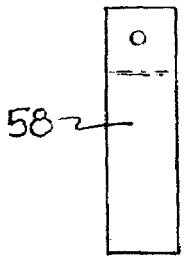
FIGS. 7*a* and 7*b* are front elevation views of the yarn thread guidance springs illustrated in FIG. 7.
Figure 7B:
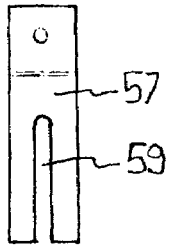

Reference will now be made to FIGS. 3 to 11 that illustrate features of the upper head assembly 26 including the yarn drive assembly 43 and the needle assembly 44 for forming the pile on the backing web 29. The drawings illustrate eight yarn supply positions equally spaced around a rotational axis 45 as shown in FIG. 4 with the assembly shown in FIG. 4 being rotated by a drive means not shown connected to a gear or sprocket wheel 46 so as to position one needle unit 47 in an operative position at a time. FIG. 4 also illustrates a supply path for a single yarn 48 although it should be understood certain parts have been omitted and with the illustrated embodiment it is possible to have up to eight different and selectable yarns supplied. It will be recognized that in the embodiment illustrated one or more yarns 48 could be used in any carpet/rug making process and other arrangements are possible where greater or less than eight yarn supply stations could be provided. The or each yarn 48 passes from a yarn bobbin or the like (not shown) through a selected eyelet 49 in an upper ring 50 of the yarn drive assembly 43. The yarn 48 then passes over a roller 51 between its peripheral surface and a guidance spring assembly 52, through a further eyelet 53 in a ring 54 immediately below the yarn drive assembly 43. As shown in FIGS. 5 and 6, a drive motor 55 driving a drive roller 56 is movable so that it is spaced from the rollers 51 carried by the upper ring 50 (FIG. 5) to allow the ring 50 to be selectably rotated about axis 45 when a new needle unit 47 (and associated yarn 48) is selected. Thereafter the drive roller 56 is positioned in a drive position (FIG. 6) to positively drive a desired length of yarn 48 downwardly. The length or height of the pile formed in the backing web 29 is defined by the length of yarn positively driven downwardly by the drive roller 56. The guidance spring structure 52 is conveniently a pair of leaf springs 57, 58, with the inner one 57 adjacent the roller 51 including an elongate yarn guidance slot 59.

Below the yarn drive assembly 43, the yarn 48 passes through a lower yarn spacer ring 60 with eight eyelets 61 spaced around its periphery. The spacer ring 60 is adjustable up or down to give adjustable pull back on the yarn as needle upper extension 70 moves to a top position. Each of the eight needle units 47 have a lower needle part 62 with a yarn eyelet 88 through which the yarn 48 passes. Above the lower needle part is a guide part 63 supporting the needle part 62 and slidably disposed in an opening 64 in a lower wall 65 of a drum structure 66 connected to the gear or sprocket wheel 46. An elongate upright rod 67 extends upwardly from the lower guide part 63 through an opening 69 in an upper wall 68 of the drum structure 66. The upright rod 67 has the upper extension 70 with a yarn eyelet 71 at its upper end. Rotatable wheels 72 are rotatably supported on a transverse axis extending from an upper region of the upright rod 67 as will be further explained hereafter. The yarn threads 48 pass downwardly from the eyelets 71 through individual eyelet opening 73 in the upper wall 68 of the drum structure 66, through individual guidance tubes 74 within the drum structure 66 and downwardly through individual eyelet openings 75 in the lower drum wall 65. In this manner, multiple yarn threads 48 are kept separate and tangles are avoided.

Figure 10:
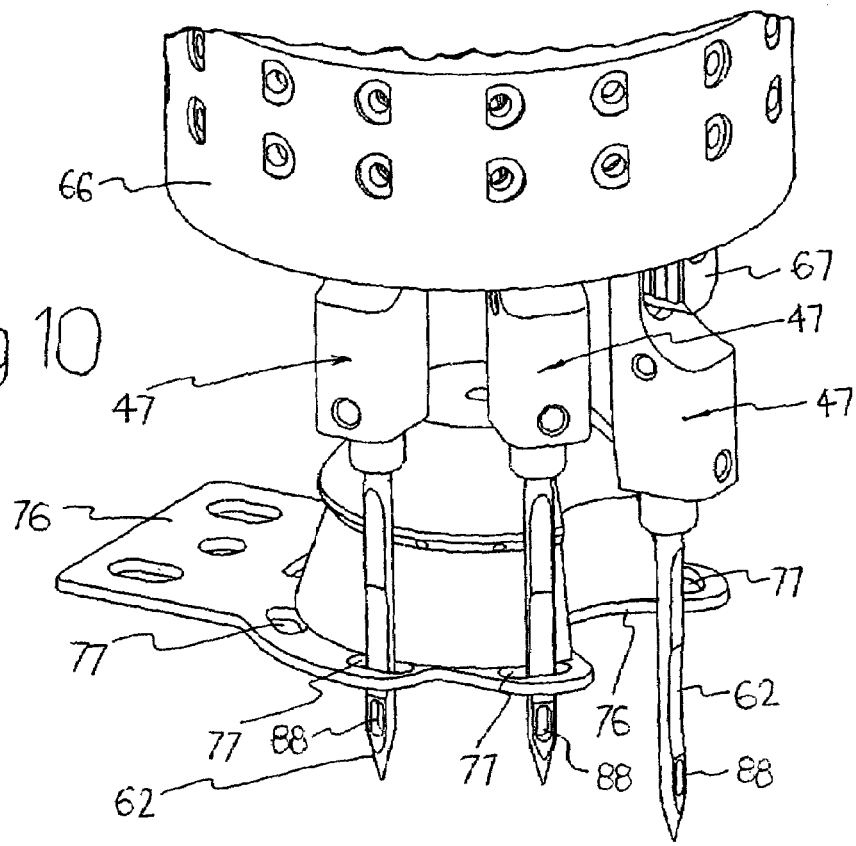
FIGS. 10 and 11 are perspective views showing features of the lower region of the needle selection mechanism utilized in the upper needle head mounting carriage illustrated in previous drawings.
Figure 11:
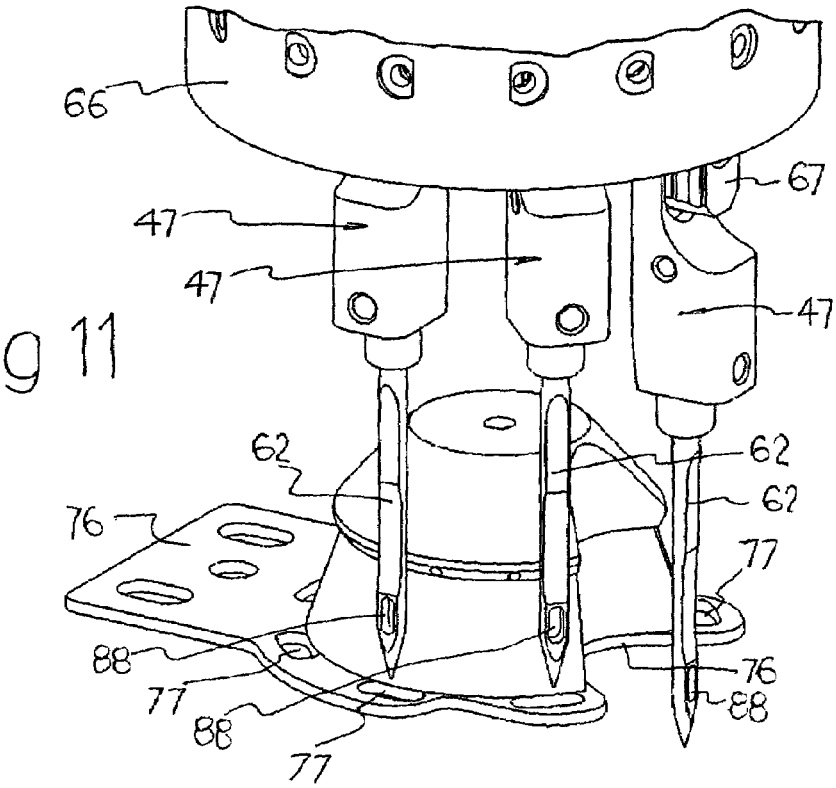

As can be seen in FIGS. 3 and 10/11, a lower needle retainer plate 76 is provided movable between a lowered position (FIG. 11) allowing the needle units 47 to rotate with the drum 66 and gear 46 when selecting a particular needle unit 47 for use, and a raised position (FIGS. 3 and 10) where all needle units 47 are retained in openings 77 in the plate 76 except the one needle unit 47 actually in use.

Figure 8:
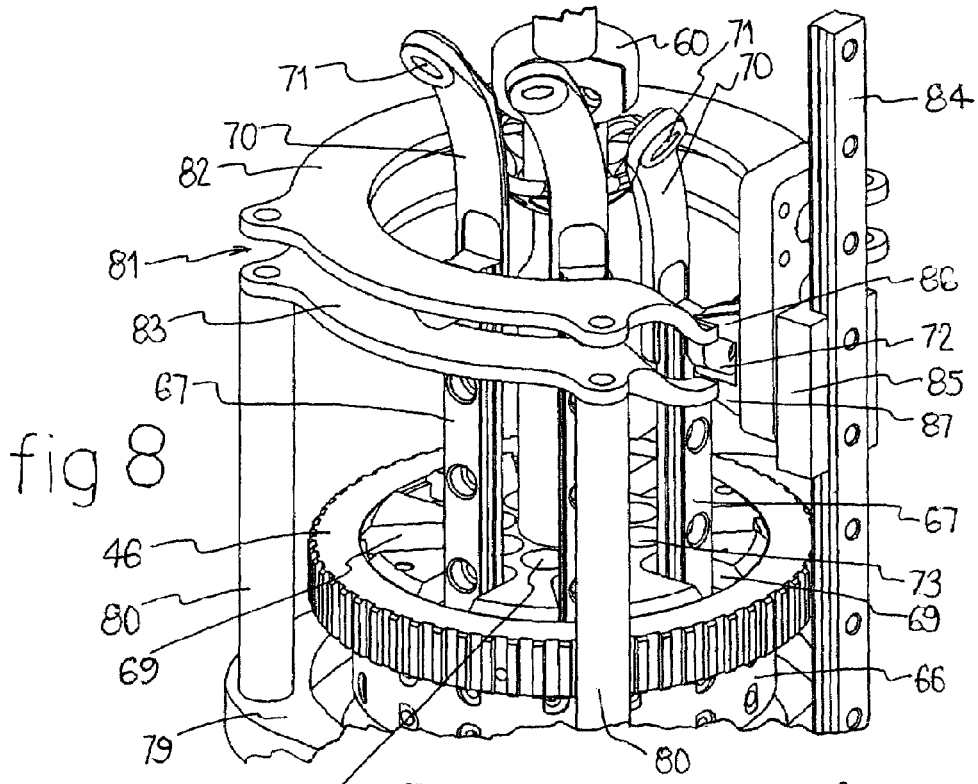
FIGS. 8 and 9 are perspective views showing features of the upper region of the needle selection mechanism utilized in the upper needle head mounting carriage illustrated in previous drawings.
Figure 9:
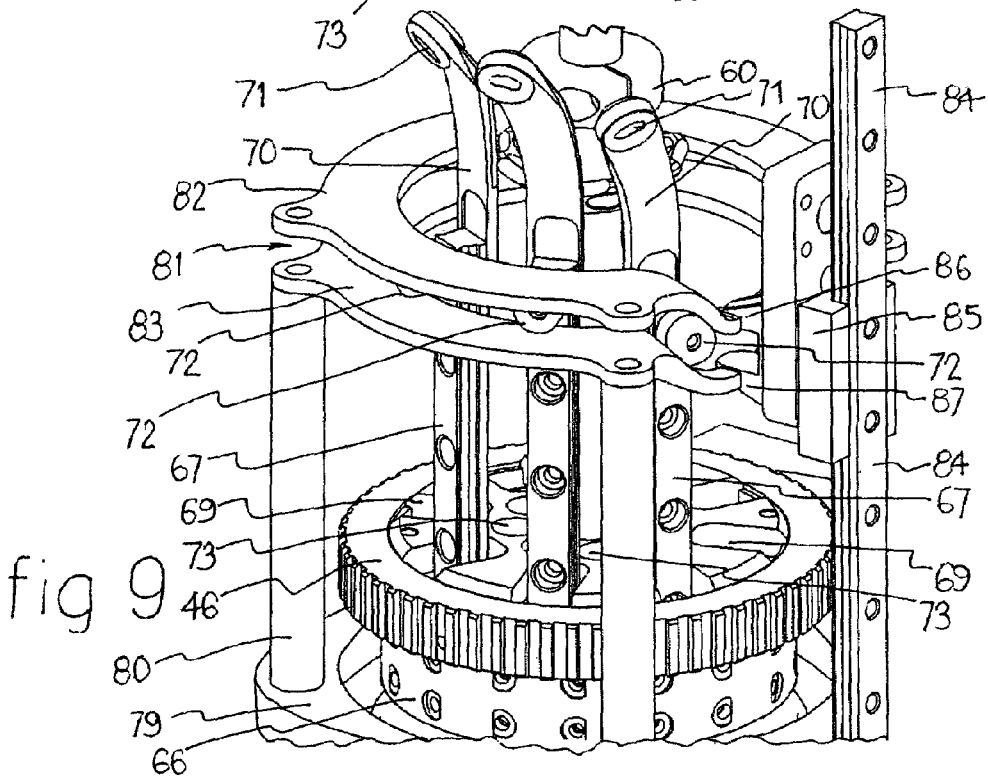

As can be seen in FIGS. 3 and 8/9, a stationary (relative to the drum 66) structure 78 is positioned generally around the drum 66 and includes a support plate 79, upright supports 80 carrying a cam track 81 adapted to receive the roller wheels 72 between upper and lower track walls 82, 83. The track walls 82, 83 are horse shoe shaped defining an open space between their free ends and the track walls 82, 83 slope downwardly towards the aforesaid open space. Adjacent the open space, an upright slide member guide 84 is provided extending upwardly from the support plate 79, the slide member guide 84 carrying a slide member 85 that is capable of a sliding upward and downward movement on the guide 84. The slide member 85 has a pair of inwardly directed flange members 86, 87 defining a space therebetween of a size to receive a particular selected roller wheel 72 therein (FIGS. 3, 8). A drive motor (not shown) is provided having an appropriate drive connection to the slide member 85 to drive the slide member 85 upwardly and downwardly with the connection via the roller wheel 72 to the attached needle unit 47 also being similarly driven upwardly or downwardly. If a new needle unit 47 and its associated yarn 48 is required to be used, then the slide member 85 is parked in the position shown in FIGS. 3 and 8 with the drum 66 thereafter being rotated to position the desired needle unit 47 and yarn 48 in the active position.

Referring now to FIGS. 12, 13*a* to 13*c* and FIGS. 14*a* to 14*d*, features of the lower head 27 are illustrated including various stages of use of same depending on the type of pile being produced. The figures illustratively show a needle 62 however it will be appreciated that the needle 62 is part of the upper head assembly 26. The lower head 27 includes a looper element 89 mounted on an appropriate linkage with a drive connected thereto to selectably swing the looper hook end 90 of the looper element 89 towards and away from the needle 62 once the needle 62 with its yarn 48 has penetrated the backing web 29. The process for making loop pile is illustrated in FIGS. 13*a* to 13*c* where the looper hook end 90 engages the yarn thread 48 while the needle 62 withdraws (FIG. 13*c*) and thereafter the looper element 89 pivots to the left in the drawings so as to release the yarn loop 96 just formed. A new loop 96 can be created by all the components of the lower head 27 and the needle 62 of the upper head 26 moving to the left by a desired distance, ie by movement of the drive belts 14, 15. The correct amount or length of yarn 48 is provided to the needle by the thread feed mechanism 43 to create a desired pile height 95.

Figure 14A:
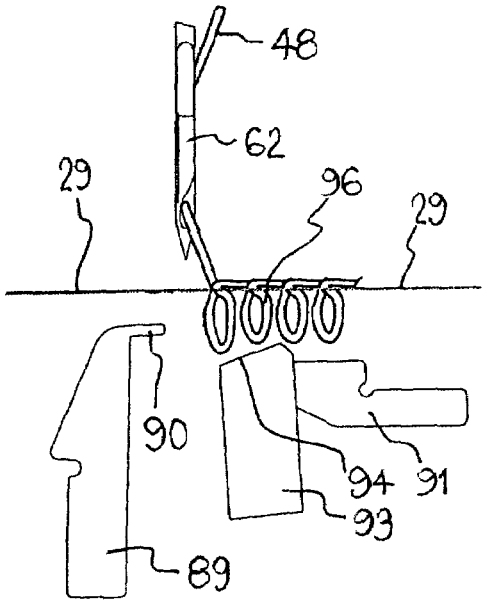
FIGS. 14*a*, 14*b*, 14*c* and 14*d* are schematic stage drawings showing sequential stages in forming cut pile on the backing material web.
Figure 14B:
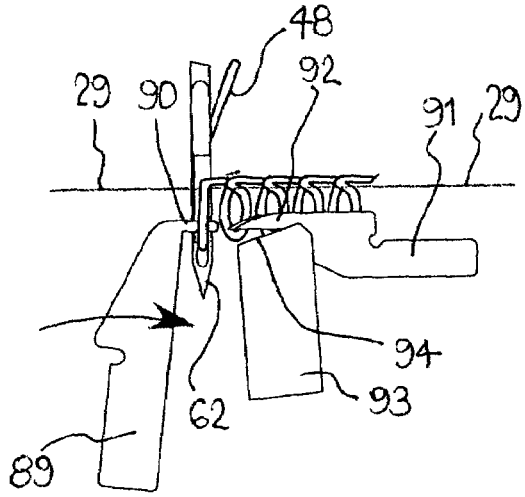
Figure 14C:
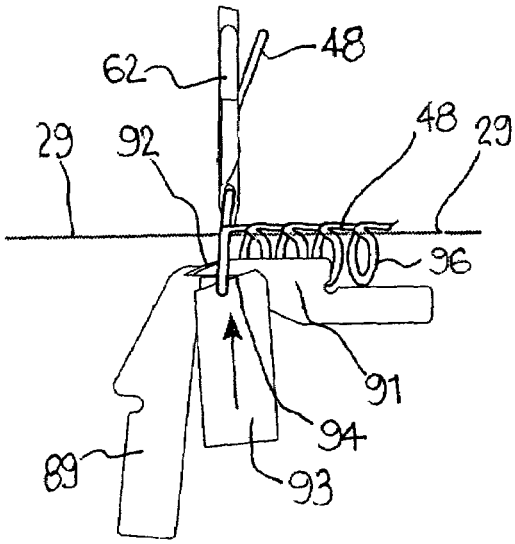
Figure 14D:
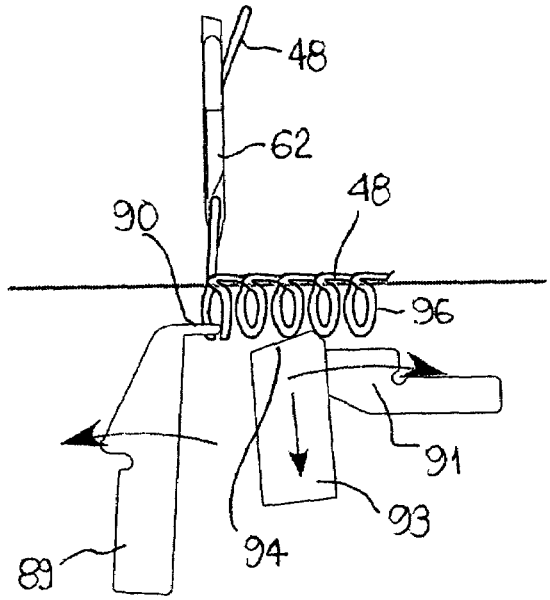

To create cut pile or to cut one or more loops of loop pile as described hereafter, the lower head 27 further includes a second hook member 91 with a hook end 92 oppositely directed to the hook end 90 of the looper element 89. As illustrated in FIG. 14*b* the needle 62 is inserted through the backing web 29 and the looper element 89 moves to the right to hold a loop of yarn 96. The second hook member 91 is raised and commences movement to the left to come between the yarn 48 and the hook end 90 of the looper element 89 as shown in FIG. 14. As the hook end 92 of the second hook member 91 moves across the hook end 90 of the looper element 89, the cutter knife 93 raises upwardly such that its end cutter edge 94 severs the loop of yarn. The needle 62 will be at the top of its stroke as the loop of yarn is cut (FIG. 14*c*). The second hook member 91 then moves towards the right and the cutter knife 93 moves downwardly (FIG. 14*d*). The looper element 89 also moves to the left to be ready to start a second stitching or loop forming operation. By selecting the loop forming action (FIGS. 13*a* to 13*c*) or the cut loop process (FIGS. 14 to 14*d*), either or both loop or cut pile can be selectably formed along any line of stitching. By varying the amount of yarn 48 delivered to the needle 62, the height of the pile 95 can be varied. By rotating the upper needle drum 66 yarns of differing colours or textures can be selected for particular areas of the carpet/rug produced.

It is intended that the carpet/rug produced be manufactures by stitching yarn in one transverse direction across a backing web 29 with stitching of the yarn being stopped after completion of one transverse run and the upper and lower heads 26, 27 are returned to the start position while the backing web is indexed or ready for a second or further stitching run. This form of stitching of pile necessarily requires the thread to be cut at the end of each run to allow the heads to be returned to start a new stitching run. Conveniently at least one and preferably at least three cut pile loops are formed at the end of each stitching run. Each stitching run can be in the form of a straight line, ie in the X-direction or it might consist of curved or angled lines given the capability of moving the upper and lower heads 26, 27 in both the X and the Y directions as described above.

Forming lines of stitched pile loops in one direction across the backing material web 29 occurs primarily, because in the illustrated components of the preferred embodiment, functional parts of the lower head are operational only in the one direction. Stitching of these pile loops in a forward and reverse direction is possible if the componentry of the lower head are reversed at the completion of each line of stitching or if a second lower head is employed for the reverse run with its components operationally reversed.

The speed of production of carpet or rugs by this apparatus might be improved by providing two or more pairs of heads 26, 27 such that each pair of heads simultaneously produces a transverse line of pile stitching. In situations where the flexibility of being able to change colours or textures of yarn threads, a limited array of needles each supplied with a desired yarn (which might be the same yarn) could be provided with each needle in the array simultaneously moving transversely to create the pile stitches. This will also improve the speed of operation but will decrease the level of flexibility.

The invention claimed is:

1. Carpet making machinery including a support and movement means to support and move a backing material web through a pile forming station in first discrete steps in a first direction, at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forming a plurality of yarn loops on one face of the backing material web, said loop forming head including at least one looper element and a loop cutting mechanism, said loop cutting mechanism being selectably operable independently of operation of said looper element, and said loop cutting mechanism including a second hook member including a hook part movable to a position within at least one said yarn loop and a cutting blade cooperable with said hook part to cut at least one said yarn loop.

2. Carpet making machinery according to claim 1 wherein the or each said needle head is driven from said second lateral region to said one lateral region without operation of a said needle of the or each said needle head passing through said backing material web.

3. Carpet making machinery according to claim 1 wherein at least one said needle of the or each said needle head forms a plurality of yarn loops on said one face of the backing material web by penetrating said backing material web when moving either from said one lateral region to said second lateral region or in a reverse direction from said second lateral region to said one lateral region.

4. Carpet making machinery according to claim 1 wherein said loop cutting mechanism of a said loop forming head is activated to cut the yarn of at least one said loop at or adjacent either of said lateral regions.

5. Carpet making machinery according to claim 4 wherein at least three adjacent said loops are cut at or adjacent either of said lateral regions.

6. Carpet making machinery according to claim 1 wherein the or each said needle head together with an associated said loop forming head, are mounted to selectably move in said second direction or said first direction, or both said first and said second directions simultaneously, during components of movement between said lateral regions.

7. Carpet making machinery according to claim 1 wherein the first discrete steps are selectably adjustable in length.

8. Carpet making machinery according to claim 1 wherein the length of said yarn loops is selectably adjustable.

9. Carpet making machinery according to claim 1 wherein two or more said needle heads are provided.

10. Carpet making machinery according to claim 1 wherein the or each said needle head carries a plurality of said needles whereby each said needle is selectably movable from a non operative position into an operative position, each said needle in use having a separate yarn supplied thereto.

11. Carpet making machinery according to claim 10 wherein the or each said needle head includes a carriage member rotatable about an axis parallel to said needles with said needles being radially spaced from said axis, said carriage member being arranged upon rotation to move each said needle to a said operative position.

12. Carpet making machinery according to claim 11 wherein a cam track is provided associated with said carriage member, said cam track maintaining said needles in a said non operative position spaced from said backing material web, in use, until a selected said needle is moved to a said operative position.

13. Carpet making machinery according to claim 10 wherein a drive mechanism is provided engageable with each said needle, only when said needle is located in a said operative position, to reciprocate said needle at the operative position to at least partially penetrate said backing material web.

14. Carpet making machinery according to claim 11 wherein said carriage member includes a plurality of separate passages each being adapted to convey a separate said yarn to an eyelet in a penetration zone of a respective said needle.

15. Carpet making machinery according to claim 1 further including yarn drive means adapted to positively deliver predetermined lengths of a said yarn from an at least semi continuous yam supply to the or each said needle of the or each said needle head, said predetermined lengths being selectably adjustable.

16. Carpet making machinery according to claim 10 further including yarn drive means adapted to positively deliver predetermined lengths of a said yarn from an at least semi continuous yarn supply to the or each said needle of the or each said needle head, said predetermined lengths being selectably adjustable.

17. Carpet making machinery according to claim 16 wherein said yarn drive means includes a yarn handling member mounted for rotation with said carriage member, said yarn handling member including a plurality of rotatable wheel or roller members each receiving a separate said yarn to pass over at least a portion of its periphery, and drive motor including a rotatable drive wheel or roller selectably movable towards and away from a drive position whereby in a said drive position the rotatable drive wheel or roller engages a respective said rotatable wheel or roller member on said yarn handling member to drive a said yarn length located between the drive wheel or roller and the wheel or roller member on said yarn handling member, over a said adjustable predetermined length.

18. Carpet making machinery according to claim 1 wherein said hook part is oppositely directed to said loop forming hook member.

19. Carpet making machinery according to claim 1 wherein the support and movement means to support and move a backing material web through the pile forming station includes a first spiked roller receiving the backing material web from a roll supply of said web, and a second spiked roller positioned on an opposite side of the pile forming station to said first spiked roller, each of said spiked rollers having spike portions penetrating in use said backing material web upon rotation thereof, said second spiked roller including a tubular sheath member surrounding the second spiked roller with a plurality of apertures through which spikes of the spiked roller are adapted to extend, said sheath member having a diameter larger than that of the second spiked roller and being rotatable about a sheath member axis of rotation displaced relative to an axis of rotation of the second spiked roller.

20. Carpet making machinery according to claim 19 wherein the spikes of said second spiked roller are withdrawn into the sheath member as the backing material web moves away from the second spiked roller.

21. Carpet making machinery according to claim 19 wherein the sheath member and the second spiked roller are driven at differing rotational speeds.

22. Carpet making machinery including a support and movement means to support and move a backing material web through a pile forming station in first discrete steps in a first direction, at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forms a plurality of yarn loops on one face of the backing material web, the or each said needle head carrying a plurality of said needles whereby each said needle is selectably movable from a non operative position into an operative position, each said needle in use having a separate yarn supplied thereto, the or each said needle head including a carriage member rotatable about an axis parallel to said needles with said needles being radially spaced from said axis, said carriage member being arranged upon rotation to move each said needle to a said operative position.

23. Carpet making machinery according to claim 22 and further including yarn drive means adapted to positively deliver predetermined lengths of a said yarn from an at least semi continuous yarn supply to the or each said needle of the or each said needle head, said predetermined lengths being selectably adjustable.

24. Carpet making machinery including a support and movement means to support and move a backing material web through a pile forming station in first discrete steps in a first direction at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forms a plurality of yarn loops on one face of the backing material web, the or each said needle head together with an associated said loop forming head, being mounted to selectably move in at least said second direction while also being selectably movable in said first direction.

25. Carpet making machinery according to claim 24 wherein the or each said needle head and its associated said loop forming head are relatively movable in said first direction.

26. Carpet making machinery according to claim 24 wherein relative movement between the or each said needle head and its associated said loop forming head in said first direction occurs in response to a predetermined positional displacement schedule ensuring correct location of the loop forming head relative to its associated said needle head when a said yarn loop is formed.

27. Carpet making machinery according to claim 24 wherein the or each said needle head carries a plurality of said needles whereby each said needle is selectably movable from a non-operative position into an operative position, each said needle in use having a separate yarn supplied thereto.

28. Carpet making machinery according to claim 24 wherein the or each said needle head includes a plurality of said needles each separately supplied with yarn and each being arranged to form a row of said yarn loops on one face of the backing material substantially simultaneously with other needles of said needle head.

29. Carpet making machinery according to claim 24 wherein two or more said needle heads are provided.

30. Carpet making machinery according to claim 24 wherein the or each said needle head together with an associated said loop forming head, are mounted to selectably move in said second direction or said first direction, or both said first and said second directions simultaneously, during components of movement from said one lateral region to said second lateral region.

31. Carpet making machinery including a support and movement means to support and move a backing material web through a pile forming station in first discrete steps in a first direction, at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forming a plurality of yarn loops including at least one looper element and a loop cutting mechanism, the or each said needle head carrying a plurality of said needles whereby each said needle is selectably movable from a non-operative position into an operative position, each said needle in use having a separate yarn thereto.

32. Carpet making machinery including a support and movement means to support and move a backing material web through a pile forming station in first discrete steps in a first direction, at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forming a plurality of yarn loops including at least one looper element and a loop cutting mechanism, the or each said needle head carries a plurality of said needles whereby each said needle is selectably movable from a non-operative position into an operative position, each said needle in use having a separate yarn supplied thereto, said machinery further including yarn drive means adapted to positively deliver predetermined lengths of a said yarn from an at least semi continuous yarn supply to the or each said needle of the or each said needle head, said predetermined lengths of a said yarn being selectably adjustable.

33. Carpet making machinery including a support and movement means to support and move a backing material web through a pile forming station in first discrete steps in a first direction, at least one needle head supported on one side of said pile forming station for movement in a second direction transverse to said first direction between one lateral region and a second lateral region whereby a needle of the or each said needle head carrying yarn penetrates said backing material web at a plurality of locations and with cooperation of a loop forming head on the other side of said pile forming station forming a plurality of yarn loops, the loop forming head including at least one looper element and a loop cutting mechanism; said support and movement means to support and move a said backing material web through the pile forming station includes a first spiked roller receiving the backing material web from a roll supply of said web, and a second spiked roller positioned on an opposite side of the pile forming station to said first spiked roller, each of said spiked rollers having spike portions penetrating in use said backing material web upon rotation thereof, said second spiked roller including a tubular sheath member surrounding the second spiked roller with a plurality of apertures through which spikes of the spiked roller are adapted to extend, said sheath member having a diameter larger than that of the second spiked roller and being rotatable about a sheath member axis of rotation displaced relative to an axis of rotation of the second spiked roller.

34. Carpet making machinery including a support and movement means to support and move a backing material web through a pile forming station in first discrete steps in a first direction for forming pile on said backing material web, said pile having opposed first and second lateral regions, at least one needle head supported on one side of said pile forming station for movement in a second direction transverse to said first direction from said one lateral region to said second lateral region whereby a needle of the or each said needle head carrying yarn penetrates said backing material web at a plurality of locations and with cooperation of a loop forming head on the other side of said pile forming station forms a plurality of yarn loops on one face of the backing material web, the or each said needle head being driven from said second lateral region to said one lateral region without operation of a said needle of the or each said needle head.

35. Carpet making machinery according to claim 34 wherein the or each said needle head has a cooperating said loop forming head, the or each said needle head together with a said cooperating loop forming head being moved in yarn loop forming steps from said one lateral region to said second lateral region to form a plurality of yard loops.

36. Carpet making machinery according to claim 35 wherein the or each said needle head carries a plurality of said needles whereby each said needle is selectably movable from a non operative position into an operative position, each said needle having a separate yarn supplied thereto, the needle in the operative position being utilized to form the yarn loop at each said yarn loop forming step.

37. Carpet making machinery according to claim 35 wherein a single said needle of the or each said needle head is utilized to form the yarn loop at each said yarn loop forming step whereby a line of said yarn loops is formed by step movement of the or each said needle head together with a said cooperating loop forming head.

* * * * *

UNITED STATES PATENT AND TRADEMARK OFFICE

CERTIFICATE OF CORRECTION

PATENT NO. : 7,478,605 B2
APPLICATION NO. : 11/241151
DATED : January 20, 2009
INVENTOR(S) : Timothy J. Modra It is certified that error appears in the above-identified patent and that said Letters Patent is hereby corrected as shown below:

In Claim 15, Column 9, Line 56, delete “yam” and insert --yarn--

Signed and Sealed this

Thirty-first Day of March, 2009

JOHN DOLL
*Acting Director of the United States Patent and Trademark Office*